US008374539B2

(12) United States Patent
Matsumoto et al.

(10) Patent No.: US 8,374,539 B2
(45) Date of Patent: Feb. 12, 2013

(54) RECORDING APPARATUS AND RECORDING METHOD

(75) Inventors: Tadashi Matsumoto, Tokyo (JP); Masaaki Naoi, Yokosuka (JP); Kota Kiyama, Kawasaki (JP); Takayuki Ninomiya, Ichikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 524 days.

(21) Appl. No.: 12/637,522

(22) Filed: Dec. 14, 2009

(65) Prior Publication Data

US 2010/0150632 A1 Jun. 17, 2010

(30) Foreign Application Priority Data

Dec. 16, 2008 (JP) ..... 2008-319632

(51) Int. Cl.
*G03G 15/01* (2006.01)
*B65H 9/00* (2006.01)
*B41J 2/01* (2006.01)

(52) U.S. Cl. ..... 399/395; 347/104

(58) Field of Classification Search ..... 399/395
See application file for complete search history.

(56) References Cited

U.S. PATENT DOCUMENTS 4,965,597 A * 10/1990 Ohigashi et al. ..... 347/118
6,324,377 B2 * 11/2001 Ando et al. ..... 399/395
6,429,891 B1 * 8/2002 Chee et al. ..... 347/263
6,486,937 B2 * 11/2002 Morton et al. ..... 355/22
2006/0221110 A1 * 10/2006 Kusakari ..... 347/15
2007/0175351 A1 * 8/2007 Boness ..... 101/485

FOREIGN PATENT DOCUMENTS

JP 62198477 A * 9/1987
JP 7-089646 A 4/1995
JP 8-133540 A 5/1996
JP 2008012701 A * 1/2008
JP 2008-105347 A 5/2008

* cited by examiner

*Primary Examiner* — Matthew G Marini
*Assistant Examiner* — Nguyen Q Ha
(74) *Attorney, Agent, or Firm* — Canon USA Inc. IP Division

(57) ABSTRACT

A recording apparatus that performs recording by ejecting ink onto a recording medium from a plurality of recording heads include a conveying roller that conveys the recording medium that is continuously fed; the plurality of recording heads arranged in the conveying direction of the conveying roller; a skew sensor that detects the amount of displacement of the position of the recording medium skewed in the widthwise direction perpendicular to the conveying direction relative to the recording heads when the recording medium is skewed with respect to the conveying direction; and an angle adjusting mechanism that rotates the recording heads relative to the recording medium on the basis of the amount of displacement detected by the skew sensor.

6 Claims, 9 Drawing Sheets

RECORDING APPARATUS AND RECORDING METHOD

BACKGROUND OF THE INVENTION

1. Field of the Invention

The present invention relates to a recording apparatus that records on a recording medium, such as roll paper, by ejecting ink thereon, as well as a recording method for the same. In particular, the present invention relates to a recording apparatus and method capable of recording under little influence of skew of the recording medium.

2. Description of the Related Art

In general, some of image forming apparatuses, in particular, color-image forming apparatuses, are capable of high-volume printing at a time using roll paper to record a plurality of recording sheets. Known examples of this type of recording apparatus that record using roll paper adopt a dry silver-salt system and an inkjet system. A roll of recording medium, such as long recording paper, is generally called roll paper. In the following description, the rolled portion of the roll paper is referred to as a roll, and a sheet-like portion drawn from the roll is referred to as a recording medium.

FIGS. 8A and 8B are diagrams showing a known image forming apparatus; and FIGS. 9A and 9B are plan views showing a conveying mechanism of the known image forming apparatus. The image forming apparatus includes a plurality of recording heads 107 in which nozzle trains are disposed in parallel. A recording medium P drawn from a roll R is conveyed to the recording heads 107 while connected with the roll R. A driving roller 133 that is rotationally driven to generate a conveying force to move the recording medium P in the direction of the arrow (shown) is disposed downstream of the recording heads 107. A conveying roller 131 is disposed upstream of the recording heads 107. The recording medium P having a fixed width is conveyed under a predetermined tension by these rollers 131 and 133. The recording heads 107 eject ink in synchronization with the conveying operations of the rollers 131 and 133 to perform recording.

First, a recording medium P conveying operation will be described from the paper feed side. The recording medium P is held by a feed rotating member 122. The recording medium P is conveyed in the conveying direction by the rotation of the feed rotating member 122. One side edge of the recording medium P held by the feed rotating member 122 is adjacent to a recording-medium reference guide 125 disposed at one widthwise edge perpendicular to the conveying direction. The opposing side edge of the recording medium P is adjacent to a recording-medium moving guide 124 disposed at the other widthwise edge, so that the recording medium P is aligned with respect to the widthwise direction. The recording medium P is conveyed while stretched by a loop detection flag 129 and is introduced in between a reference aligning guide 115 and a moving aligning guide 116 that aligns the widthwise position of the recording medium P. As shown in FIGS. 9A and 9B, the recording medium P is prevented from being conveyed in a direction skewed with respect to the conveying direction using the reference aligning guide 115 and the moving aligning guide 116.

The loop detection flag 129 is provided to swing in the direction of the arrow C. The loop detection flag 129 gives a fixed tension in the conveying direction to the recording medium P. When the recording medium P is conveyed to reduce the amount of loop, the loop detection flag 129 swings. The swing of the loop detection flag 129 is detected by a sensor. A controller rotates the feed rotating member 122 in accordance with the detection signal of the sensor, so that the recording medium P is conveyed toward the aligning guides 115 and 116. As a result, the amount of loop increases, so that the loop detection flag 129 returns to the initial position, and the detection is cancelled; thus, the operation of the feed rotating member 122 is stopped, and the fixed tension of the recording medium P is maintained again. By repeating this operation during the conveying operation, the recording medium P is conveyed, with a stable tension generated on the recording medium P at the upstream side of a conveying roller 131.

The recording medium P, whose one side edge is positioned by the reference aligning guide 115, is conveyed into the nip between the conveying roller 131 and a driven roller 132. The recording medium P is given a fixed conveying force by the conveying roller 131 and the driven roller 132 that rotates following the conveying roller 131 while applying pressure thereto and is conveyed in a recording area at which recording is performed by recording heads 107.

The recording area has the recording heads 107 (107K, 107C, 107M, and 107Y) arranged in the conveying direction, in which a large number of nozzles are arrayed in the direction perpendicular to the conveying direction to spatter the ink. The recording area further has a plurality of upper rollers 134, from the upstream side to the downstream side, for preventing the recording medium P from floating up. The upper rollers 134 decrease the interval between the recording heads 107 and the recording medium P to about 1.00 mm to reduce the displacement of the ink landing positions due to the spattering of the ink, thereby allowing high definition of the image.

The recording medium P on which a high-definition image is formed in the recording area is conveyed by the driving roller 133 and the upper rollers 134 into a cutter area that is a back end process area. The upper rollers 134 are in contact with upper roller cleaners 135 at upper positions, and when coming into contact with the upper surface (recording surface) of the recording medium P, the ink transferred from the recording surface is wiped out by the upper roller cleaners 135. This prevents the ink sticking to the upper rollers 134 from being transferred to the recording medium P when the upper rollers 134 rotate again into contact with the recording surface of the recording medium P. The upper roller cleaners 135 are placed at portions corresponding to the individual upper rollers 134 that are disposed at the region in which the plurality of recording heads 107 are disposed.

The four recording heads 107 shown in FIGS. 8A and 8B are fixed to an elevating head frame 106 and are disposed at positions having a fixed interval from the recording medium P during recording. For storage of the recording apparatus or for a head recovery operation, the elevating head frame 106 is moved to vertically move the recording heads 107. Examples of the structure for the vertical movement include a structure for pulse control using a stepping motor (not shown) and a structure in which the height of the recording heads 107 is held fixed by butting the elevating head frame 106 to a height reference provided in the vertical direction.

In the cutter area, the continuously conveyed recording medium P is stopped during a cutting operation, and after the cutting operation, the recording medium P is conveyed to the next cutting position at a relatively high speed about three times the conveying speed. This operation is repeated, so that the recording medium P is cut to a fixed length in the cutter area. Thus, the recording medium P is conveyed intermittently. The cutter area is therefore provided with a loop region, in which a loop is formed in a portion where the recording medium P is continuously fed to thereby temporarily hold the recording medium P while the recording medium P is stopped during the cutting operation. The cut recording medium P is output from the cutter area, and the series of recording operation is completed.

Although the thus-configured recording apparatuses have generally been used as low-resolution printers for post cards, calling cards, labels, etc. the use for recording high-definition high-quality picture images is considered with the recent remarkable improvement of the inkjet recording system and the material of recording media. In particular, recording apparatuses in which a plurality of long recording heads having nozzle trains having a width equal to the recording width of recording media are disposed in the conveying direction are capable of high-speed recording of about 30 to 100 per minute, thus having a tendency to increase in demand.

The technology for conveying a recording medium on the conveying path, with the side edges of the recording medium positioned, is disclosed in Japanese Patent Laid-Open No. 08-133540.

However, with the above-described configuration, if the angle of the reference aligning guide 115 with respect to the nip between the conveying roller 131 and the driven roller 132 is not a right angle with high accuracy, the skew of the recording medium P occurs at the beginning of the feeding operation. If the recording medium P skewed with respect to the conveying direction is fed to the conveying roller 131, the conveying roller 131 conveys the recording medium P in the direction of the skew, so that the recording medium P is continuously skewed. However, the skew is corrected owing to the influence of a tension generated in the recording medium P between the feed rotating member 122 and the conveying roller 131, and is gradually settled. However, if the conveying force at the nip is strong, the skew of the recording medium P is not settled, so that the recording medium P is continuously skewed, causing a paper jam.

To convey the recording medium P smoothly, a slight gap is needed between both widthwise edges of the recording medium P and the guides 115 and 116. The side edge faces of the roll R are not sometimes flat due to an error of the width of the recording medium P to cause deviation of the positions of the side edges between the vicinity of the outer circumference and the vicinity of the center. Therefore, gaps are needed between the recording medium P and the guides 115 and 116. Thus, even after the skew at the beginning of the feeding operation is settled during a conveying operation, as described above, the conveyed recording medium P is skewed at a low frequency due to the gaps.

The skew generated at the low frequency is caused by the gaps that are necessary to convey the recording medium P, described above. However, to reduce the conveying resistance of the recording medium P, these gaps should not be eliminated. Therefore, to reduce the skew at the beginning of the feeding operation, various configurations are proposed for bringing the widthwise direction of the recording medium P perpendicular to the conveying direction using a skewing roller that conveys the recording medium P in a direction skewed from the conveying direction.

In particular, high-quality printing using a plurality of long inkjet recording heads is affected by even high-frequency skew generated after the first skew is settled. Therefore, the configuration using a plurality of long recording heads has the problem that the skew induces the displacement of ink landing positions among the parallel nozzle trains, so that high-quality images cannot be formed.

To constitute the nozzle trains of the recording heads at relatively low cost, there is also a configuration in which a plurality of chips each having relatively short nozzle trains are arranged in the column direction to constitute long recording heads. However, this configuration is required to reduce the skew more because when the recording medium is skewed, a phenomenon in which the gaps between the individual chips change to generate alternate white and black stripes on the recording surface of the recording medium is caused depending on the amount of skew. In general, the amount of widthwise displacement of the recording medium p when the recording medium P is skewed must be held within ±20 μm or less, which is difficult to achieve with the present configuration of the conveying mechanism.

SUMMARY OF THE INVENTION

The present invention provides a recording apparatus in which the accuracy of ink landing positions can be improved during skew at the beginning of a paper feeding operation and even during high-frequency skew generated after the skew is settled, as well as a recording method for the same. In particular, the present invention provides a recording apparatus capable of high-quality recording by improving the accuracy of ink landing positions relative to a recording medium, as well as a printing method for the same.

A recording apparatus according to an embodiment of the present invention is a recording apparatus that performs recording by ejecting ink onto a recording medium from a recording unit. The recording apparatus includes a conveying unit configured to convey a continuously fed rolled recording medium; a plurality of recording units arranged in the conveying direction of the conveying unit; a detecting unit configured to detect the amount of displacement of the recording medium in the widthwise direction perpendicular to the conveying direction with respect to the recording units when the recording medium is skewed with respect to the conveying direction; and a rotating unit configured to rotate the recording units on the basis of the amount of displacement detected by the detecting unit.

According to an embodiment of the present invention, the accuracy of ink landing positions relative to the recording medium can be improved. Thus, the present invention can improve recording medium recording quality.

Further features of the present invention will become apparent from the following description of exemplary embodiments with reference to the attached drawings.

DESCRIPTION OF THE EMBODIMENTS

Embodiments of the present invention will be described with reference to the drawings.

The following embodiments will be described using a printer as an example of a recording apparatus that adopts an inkjet recording system.

In the present invention, "recording" indicates forming significant information, such as characters and figures, and expressing either significant or insignificant information so that humans can perceive it, and "recording" also indicates forming images, designs, patterns, etc. on a recording medium and processing a recording medium.

"Recording medium" indicates not only paper used in general recording apparatuses but also ink receptive media, such as cloth, plastics, metal plates, glass, ceramics, wood, and leather.

"Ink" should be given a broad definition as the definition of "recording". Accordingly, "ink" indicates liquid that is put onto a recording medium to form images, designs, patterns, etc., to process the recording medium, or to process ink (for example, to solidify or insolubilize coloring material in ink put onto the recording medium).

A description of the same configuration of the recording apparatus of the embodiments as the related-art configuration described with reference to FIGS. 8A and 8B and FIGS. 9A and 9B will be omitted.

First Embodiment

Figure 1A:
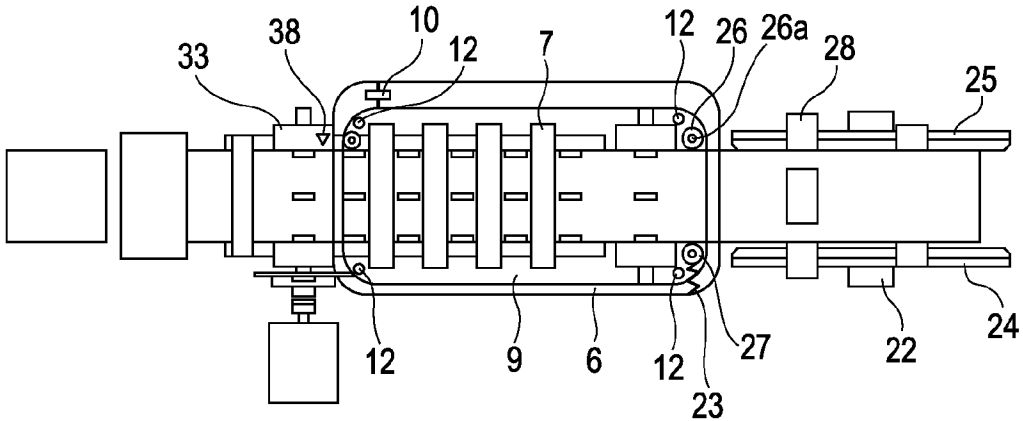
FIG. 1A is a plan view of an image forming apparatus according to a first embodiment of the present invention.
Figure 1B:
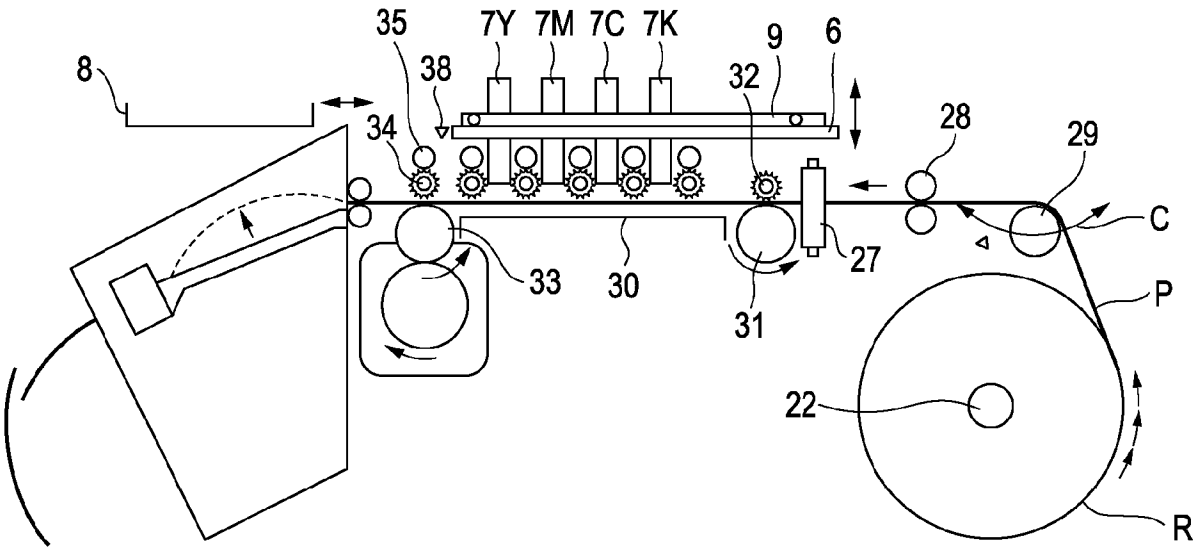
FIG. 1B is a sectional view of the image forming apparatus.
Figure 2:
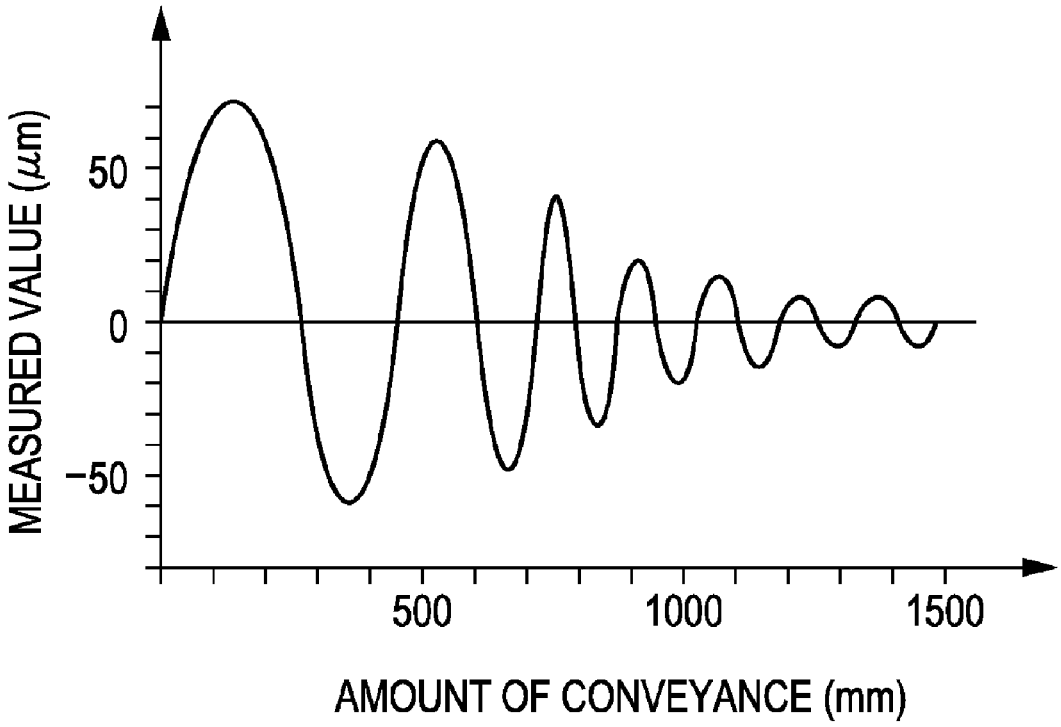
FIG. 2 is a graph showing the measurements of skew generated when a recording medium is conveyed.

FIGS. 1A and 1B are diagrams showing an image forming apparatus of the first embodiment. FIG. 1A is a plan view and FIG. 1B is a sectional view. FIG. 2 is a graph showing the measurements of skew generated when a recording medium is conveyed.

As shown in FIGS. 1A and 1B, the roll R that is a roll of the recording medium P is held on the feed rotating member 22. The recording medium P drawn from the roll R is conveyed to the nip between a conveying roller 31 and a driven roller 32. A loop detection flag 29 gives a fixed tension to the recording medium P between the roll R and a feed roller pair 28.

A platen 30 is provided at a position facing a plurality of recording heads 7 (7Y, 7M, 7C, and 7K) serving as a recording unit, downstream of the conveying roller 31 and the driven roller 32 serving as a conveying unit. The recording medium P passes directly under the recording heads 7 along the platen 30 and is conveyed to a driving roller 33.

The long recording heads 7 in which a plurality of nozzles that spatters ink are arrayed in the widthwise direction of the recording medium P are retained by an angle-adjusting head frame 9. In this embodiment, four recording heads 7Y, 7M, 7C, and 7K for black (K) ink, cyan (C) ink, magenta (M) ink, and yellow (Y) ink are disposed in this order; however, the number of the recording heads 7 are not limited to four. Accordingly, the number of the recording heads 7 may be more than four, or alternatively, a combined recording head in which recording heads are combined into one is possible. The recording unit includes all recording heads in which color nozzle trains are arrayed in columns.

Figure 4A:
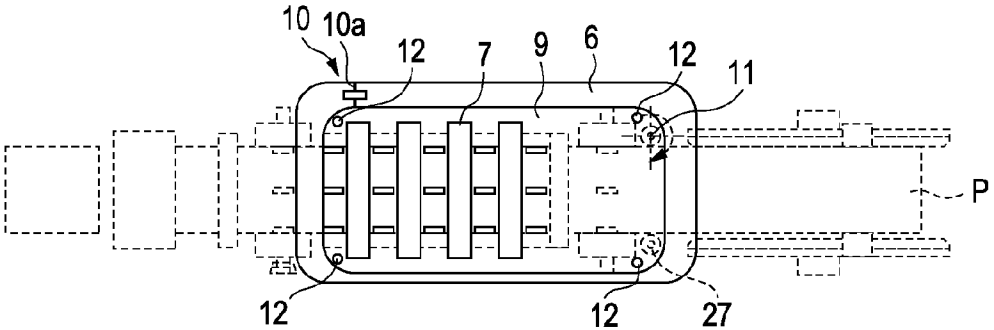
FIG. 4A is a plan view for explaining the operation of an angle adjusting mechanism of the first embodiment.
Figure 4B:
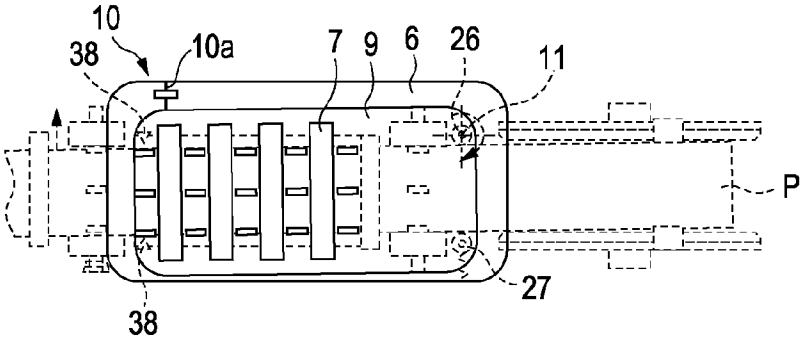
FIG. 4B is a plan view for explaining the operation of the angle adjusting mechanism.
Figure 4C:
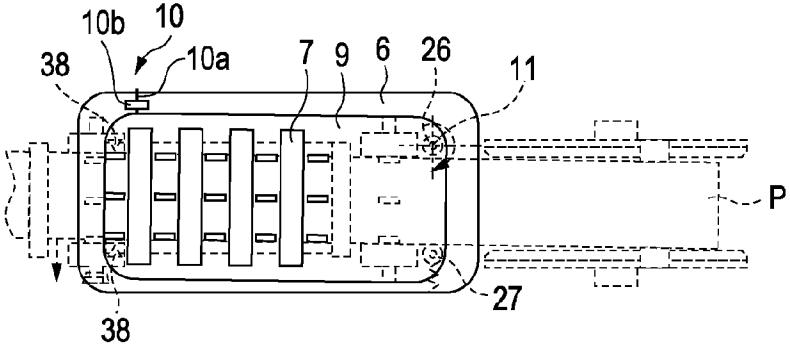
FIG. 4C is a plan view for explaining the operation of an angle adjusting mechanism.

As shown in FIG. 4A to 4C, the angle-adjusting head frame 9 is supported by an elevating head frame 6 via a rotation reference shaft 11. The angle-adjusting head frame 9 is rotatable about the rotation reference shaft 11 while held parallel to the recording medium P guide surface of the platen 30. The plurality of recording heads 7Y, 7M, 7C, 7K are fixed to the angle-adjusting head frame 9 serving as a retaining unit.

The elevating head frame 6 can move up and down. The angle-adjusting head frame 9 is moved as the elevating head frame 6 moves up and down. For example, at a time except during a recording operation, the elevating head frame 6 moves upward, and a cap 8, shown in FIG. 1B, moves laterally toward below the recording heads 7 to prevent nozzle clogging due to the evaporation of the ink in the nozzles. Subsequently, the recording heads 7 move downward to the position of the cap 8, so that the periphery of the nozzles of the recording heads 7 is closed by the cap 8. This configuration allows the halted (stored) state of the recording heads 7 to be maintained for a long period. This embodiment is configured to operate as in the general inkjet recording apparatuses, in which a recovery operation, a pre-ejecting operation, etc. of the recording heads 7 can be performed individual positions as the elevating head frame 6 moves up and down.

Figure 5A:
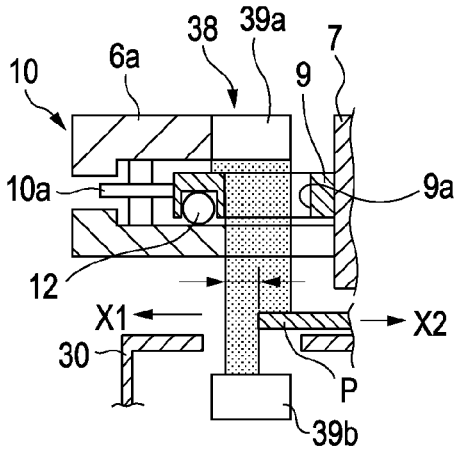
FIG. 5A is a sectional view of a skew sensor of the first embodiment cut along a plane perpendicular to the conveying direction.

As shown in FIG. 5A, the angle-adjusting head frame 9 has recessed portions at the four corners of the lower surface thereof facing the elevating head frame 6. Balls 12 are disposed in the individual recessed portions. The angle-adjusting head frame 9 is placed on the elevating head frame 6, with the balls 12 therebetween. Thus, the angle-adjusting head frame 9 can rotate on the elevating head frame 6 at low load while holding parallel to the guide surface of the platen 30 as the balls 12 rotate in the recessed portions. The rotation reference shaft 11, the balls 12, and the elevating head frame 6 constitute a supporting unit that rotatably supports the angle-adjusting head frame 9.

The elevating head frame 6 has an angle adjusting mechanism 10 fixed thereto at a downstream position of the recording heads 7, for moving the angle-adjusting head frame 9. This angle adjusting mechanism 10 has a driving shaft 10*a* connected to the angle-adjusting head frame 9. In this embodiment, the angle adjusting mechanism 10 adjusts the angle of the angle-adjusting head frame 9 by moving the driving shaft 10*a* in the axial direction using a linear stepping motor 10*b*. Recent linear stepping motors can move the driving shaft 10*a* by 10 μm per step at an operation range of ±0.5 mm. The angle adjusting mechanism may have any other configuration that allows high-accuracy drive control.

The angle adjusting mechanism 10 pushes and draws the angle-adjusting head frame 9 downstream of the recording heads 7 by moving the driving shaft 10*a* in the widthwise direction of the recording medium P. The angle adjusting mechanism 10 rotates the angle-adjusting head frame 9 about the rotation reference shaft 11 by moving the driving shaft 10*a* to thereby control the angle of the recording heads 7 with respect to the conveying direction. At that time, the plurality of recording heads 7 rotates about the rotation reference shaft 11 together with the angle-adjusting head frame 9.

This image forming apparatus further has, at the downstream portion of the elevating head frame 6, a skew sensor 38 that is a detecting unit that detects the amount of widthwise displacement of the recording medium P when the recording medium P is skewed. FIGS. 4A to 4C are plan views of the angle adjusting operation. FIGS. 5A to 5E are sectional views of the skew sensor 38 cut along a plane perpendicular to the conveying direction. An example of the detecting operation by the skew sensor 38 and the adjusting operation of the angle adjusting mechanism 10 corresponding to the detecting operation will be described with reference to FIGS. 4A to 4C and FIGS. 5A to 5E.

The skew sensor 38 includes a light emitting section 39*a* and an analog sensor equipped with a photodetector 39*b*. The elevating head frame 6 has a supporting unit 6*a* extending above the angle-adjusting head frame 9 to support the light emitting section 39*a* above the angle-adjusting head frame 9. The rear surface of the platen 30 is provided with the analog sensor equipped with the photodetector 39*b* to receive light emitted from the light emitting section 39*a*. The use of the analog sensor as the skew sensor 38 allows changes of the widthwise edges of the recording medium P and changes in light quantity caused by the changes of the angle-adjusting head frame 9 to be detected.

As shown in FIG. 5A, part of the light emitted from the light emitting section 39*a* of the skew sensor 38 is intercepted at one end by one end of a window 9*a* formed in the angle-adjusting head frame 9, and the other end is intercepted by one side edge of the recording medium P located therebelow. The light passes through the angle-adjusting head frame 9 and by the widthwise edge of the recording medium P and is received by the photodetector 39*b*, so that the skew sensor 38 detects the width of the light narrowed by the angle-adjusting head frame 9 and the recording medium P.

Figure 5B:
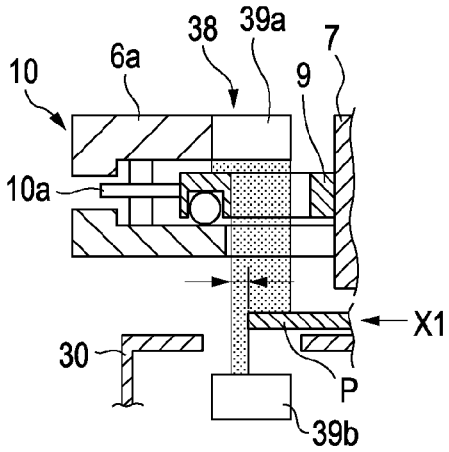
FIG. 5B is a sectional view of the skew sensor cut along a plane perpendicular to the conveying direction.
Figure 5C:
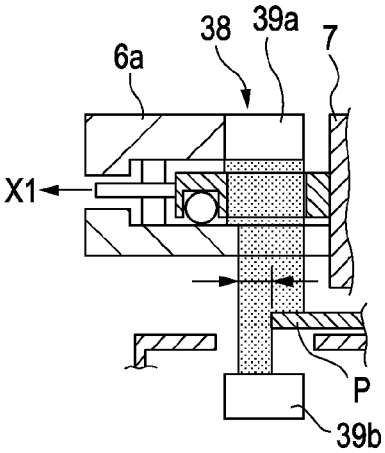
FIG. 5C is a sectional view of the skew sensor cut along a plane perpendicular to the conveying direction.

FIG. 5B shows a case in which the recording medium P is skewed during conveyance, so that the widthwise edge of the recording medium P moves in the direction of arrow X1 in FIG. 5B. At that time, as the side edge of the recording medium P moves in the direction of X1, the quantity of light that passes through the angle-adjusting head frame 9 and by the side edge of the recording medium P to reach the photodetector 39*b* is decreased. The decrease in light quantity changes the output from the skew sensor 38, so that the movement of the side edge of the recording medium P in the direction of X1 is detected. As shown in FIG. 5C, the angle-adjusting head frame 9 is moved in the direction of X1 by controlling the angle adjusting mechanism 10 using a control circuit (not shown) on the basis of the detection result, that is, the amount of displacement of the side edge of the skewed recording medium P. The angle adjusting mechanism 10 moves the angle-adjusting head frame 9 so that the quantity of light that the photodetector 39*b* of the skew sensor 38 receives becomes equal to that at the initial state, described above. By controlling the operation of the angle-adjusting head frame 9 in this way, the relative positional relationship between the side edge of the recording medium P and the angle-adjusting head frame 9 is maintained constant in the widthwise direction perpendicular to the conveying direction of the recording medium P. That is, the position of the recording heads 7 relative to the widthwise direction of the recording medium P is adjusted by the angle adjusting mechanism 10.

Figure 5D:
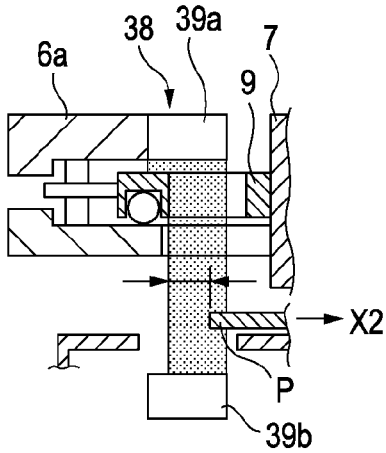
FIG. 5D is a sectional view of the skew sensor cut along a plane perpendicular to the conveying direction.
Figure 5E:
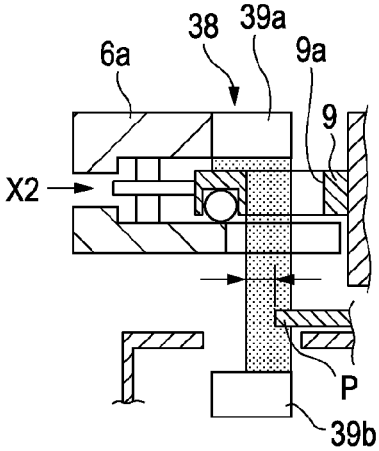
FIG. 5E is a sectional view of the skew sensor cut along a plane perpendicular to the conveying direction.

Likewise, when the recording medium P is skewed with conveyance, so that the widthwise edge of the recording medium P moves in the direction of arrow X2, the recording medium P comes into the state shown in FIG. 5D. When the recording medium P moves in the direction of X2, the quantity of light that passes through the angle-adjusting head frame 9 and by the edge of the recording medium P to reach the photodetector 39*b* increases, so the output from the skew sensor 38 changes, so that the movement of the edge of the recording medium P in the direction of X2 is detected. As shown in FIG. 5E, the angle-adjusting head frame 9 is moved in the direction of X2 by controlling the angle adjusting mechanism 10 using the control circuit on the basis of the detection result so that the quantity of light that the photodetector 39*b* receives becomes equal to that at the initial state, described above. As a result, the relative positional relationship between the side edge of the recording medium P and the angle-adjusting head frame 9 are maintained constant, so that the position of the recording heads 7 relative to the widthwise direction of the recording medium P is adjusted, thus improving the accuracy of the ink landing positions relative to the recording medium P.

Figure 7:
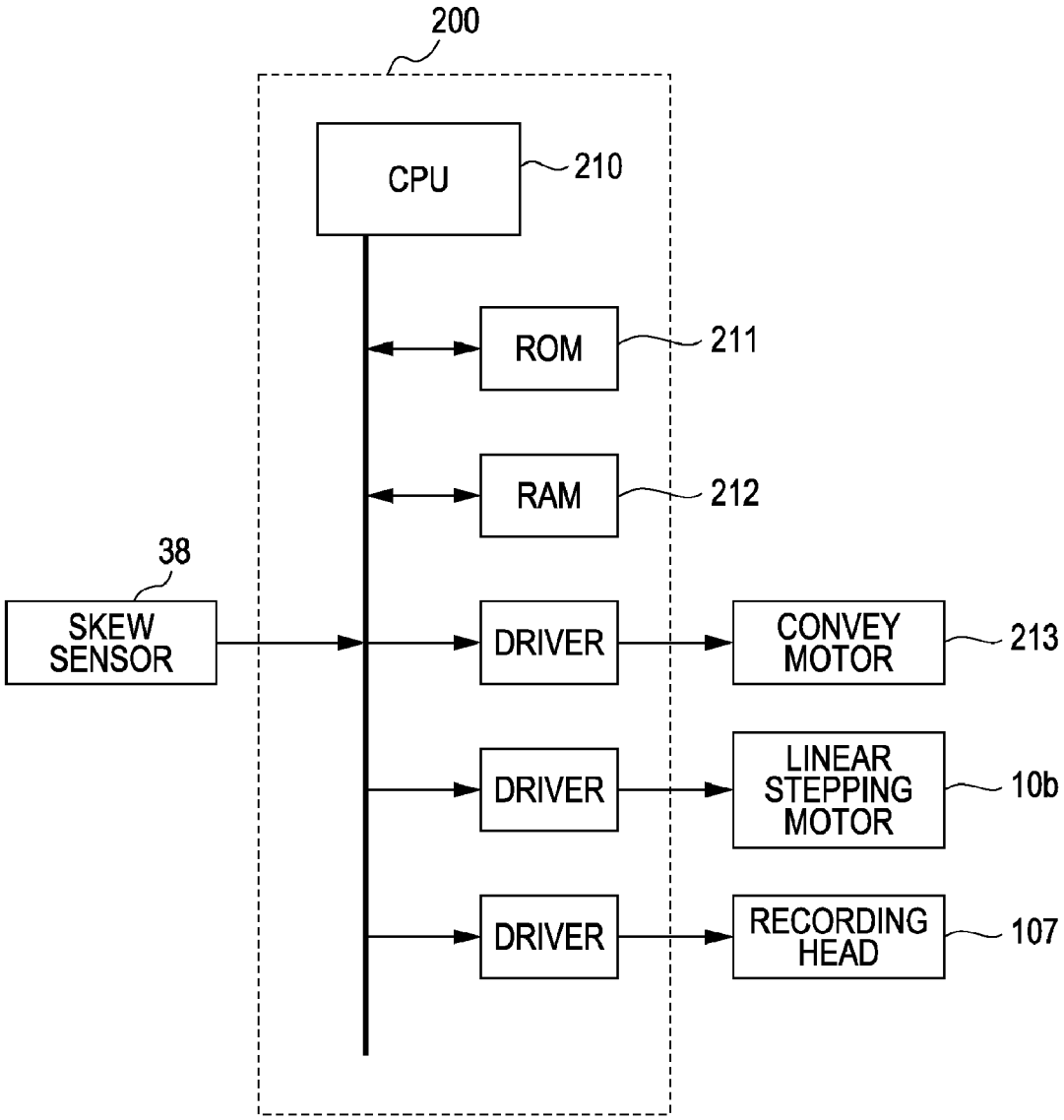
FIG. 7 is a control block diagram of the image forming apparatus.
Figure 8A:
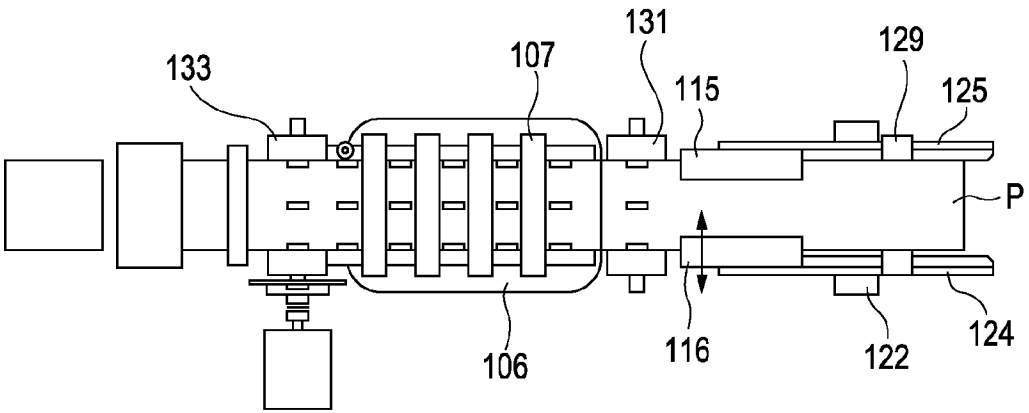
FIG. 8A is a plan view of a known image forming apparatus.
Figure 8B:
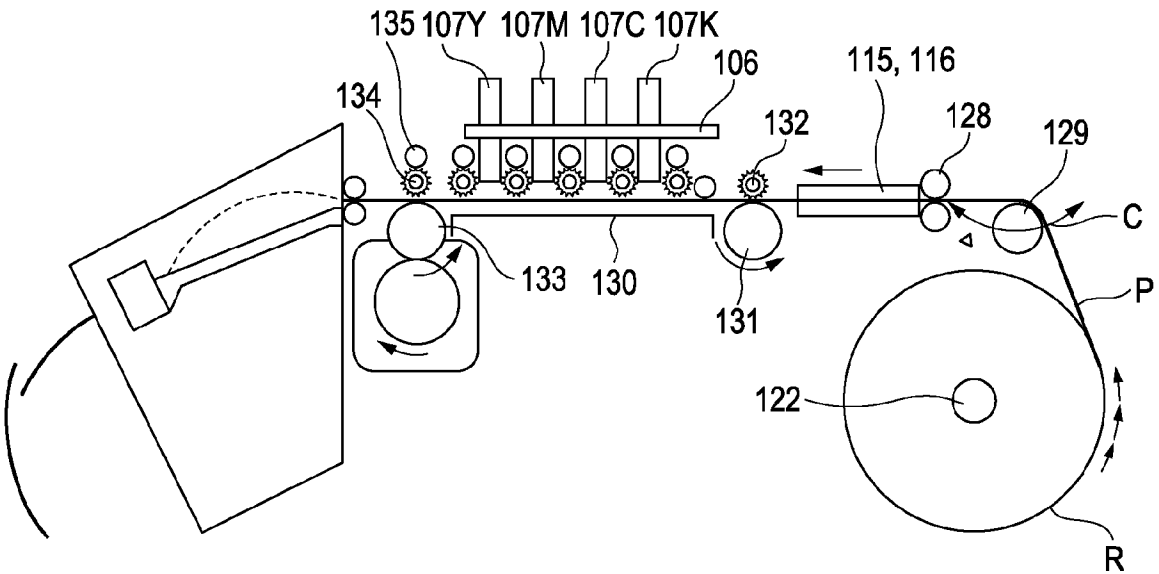
FIG. 8B is a sectional view of the known image forming apparatus.
Figure 9A:
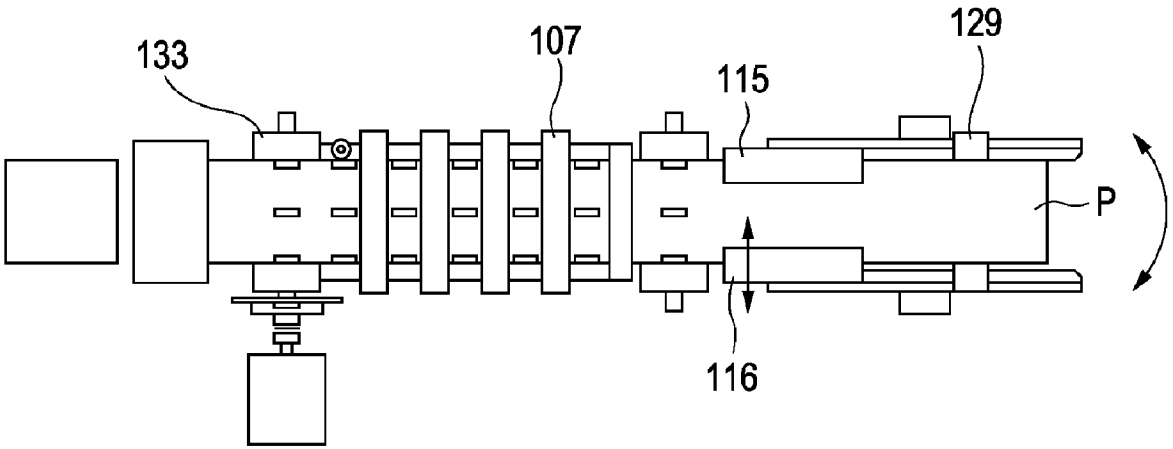
FIG. 9A is a plan view of a conveying mechanism of the known image forming apparatus.
Figure 9B:
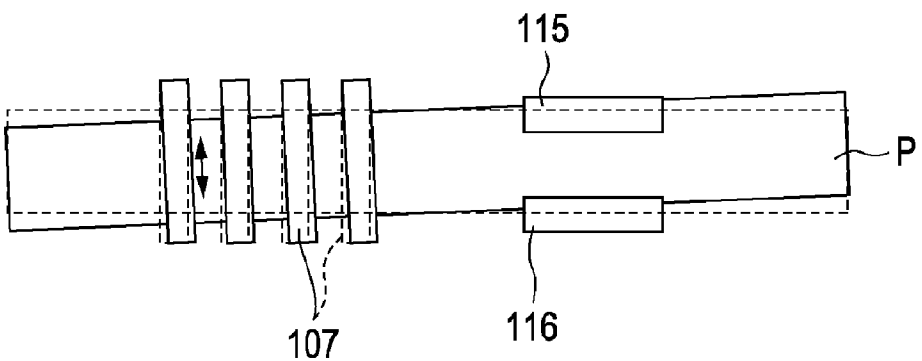
FIG. 9B is a plan view of the conveying mechanism.

FIG. 7 is a control block diagram of the recording apparatus.

Reference numeral 200 denotes a control circuit that controls the printer. The control circuit is provided with a CPU 210 that processes information and issues various control commands, a ROM 211 to which control data etc. are written, a RAM 212 serving as a region into which record data etc. are expanded, and various drivers that drive various motors and the recording heads.

Reference numeral 213 denotes a convey motor that drives the conveying roller 131 and the driving roller 133. Reference numeral 38 denotes the skew sensor equipped with the light emitting section 39*a* and the photodetector 39*b*.

Next, referring to FIGS. 1A, 1B, and 3, the operation of controlling the skew of the recording medium P will be described.

As shown in FIGS. 1A and 1B, the feed roller pair 28 is provided downstream of the loop detection flag 29 in the conveying direction and prevents a decrease in conveying accuracy and unstable occurrence of the skew of the recording medium P under the influence of the upstream loop. A skew restricting mechanism serving as a skew restricting unit that aligns the recording medium P with respect to the widthwise direction and aligns the position of the recording medium P constantly at a fixed distance from a predetermined point even if it is skews is provided downstream of the feed roller pair 28. That is, the recording medium P is controlled to be constantly located at a position around the predetermined point.

The skew restricting mechanism includes a reference roller 26 serving as a first roller and is rotatably supported by a rotation shaft 26*a* serving as a rotation reference shaft for rotating the recording medium P. The skew restricting mechanism further includes a press roller 27 serving as a second roller disposed at a position opposing the reference roller 26, with the recording medium P in between, to be movable in the widthwise direction of the recording medium P. The skew restricting mechanism further includes a press roller spring 23 serving as an urging unit that pushes the press roller 27 to bring the recording medium P into contact with the reference roller 26.

The rotation shaft 26*a* of the reference roller 26 is disposed in an orientation perpendicular to the conveying direction and to the widthwise direction of the recording medium P. The reference roller 26 is disposed in such a manner as to be fixed with respect to the widthwise direction of the recording medium P and to be rotatable in the direction of arrow B in a plane parallel to the recording surface of the recording medium P in FIG. 3A. The reference roller 26 rotates in contact with one side edge of the recording medium P conveyed in the conveying direction to align the position of the side edge of the recording medium P.

The rotation shaft 27*a* of the press roller 27 that pushes one widthwise edge of the recording medium P against the reference roller 26 is disposed in an orientation perpendicular to the conveying direction and to the widthwise direction of the recording medium P, as the reference roller 26 is.

The pressure of the press roller 27 is set larger than a force that acts in the widthwise direction of the recording medium P to skew the recording medium P by the nip between the conveying roller 31 and the driven roller 32.

Even if the recording medium P is skewed, the side edge thereof is constantly held in contact with the circumferential surface of the reference roller 26. That is, the recording medium P is constantly skewed to rotate about the rotation center of the reference roller 26.

To improve the conveying accuracy, a metal roller whose surface is subjected to abrasive blasting is used as the conveying roller 31. By using a rubber roller with a hardness of about 75 degrees as the driven roller 32, a force generated in a direction in which the recording medium P is skewed with respect to the conveying direction is decreased. By increasing the nip pressure, the conveying force is increased. The driving roller 33 located downstream of the conveying roller 31 and the driven roller 32 is given the same configuration.

Figure 3A:
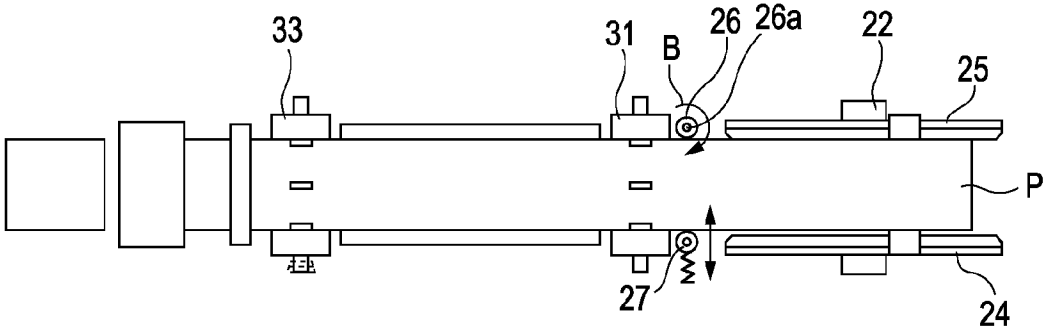
FIG. 3A is a plan view of a conveying mechanism of the first embodiment.
Figure 3B:
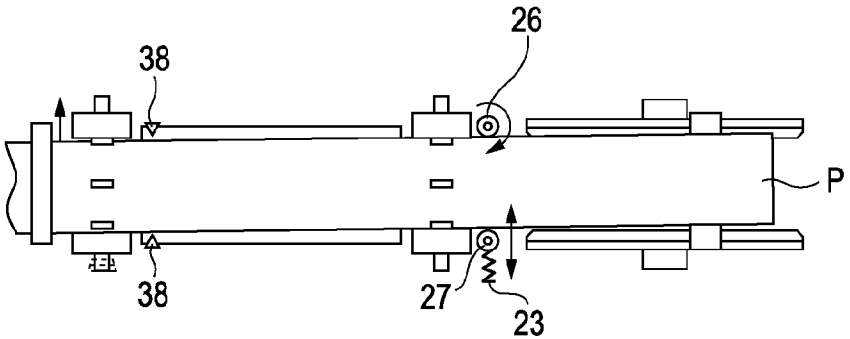
FIG. 3B is a plan view of the conveying mechanism.
Figure 3C:
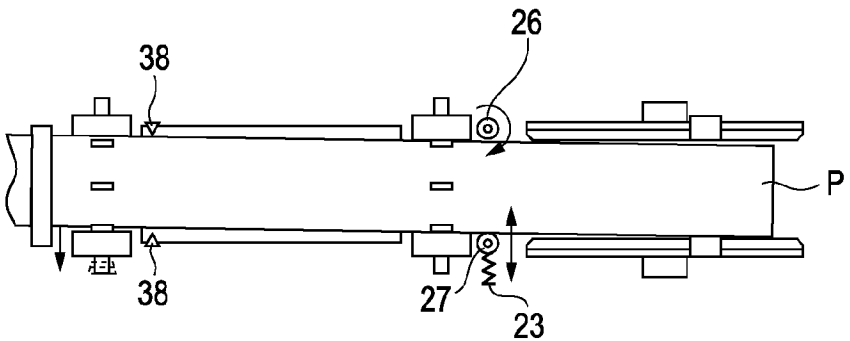
FIG. 3C is a plan view of the conveying mechanism.

Accordingly, if the skewing direction changes at the recording medium P feeding side, the skewing direction of the recording medium P changes about the rotation center of the reference roller 26, as shown in FIGS. 3A to 3C. FIG. 2 shows the result of measurement of the skew of the recording medium P with this configuration. As shown in FIG. 2, the recording medium P is skewed at fixed intervals at the beginning of the paper feeding operation. This is because the widthwise direction at the front end of the recording medium P is displaced from the direction perpendicular to the conveying direction when the recording medium P is held in the nip of the conveying roller 31 at the beginning of the paper feeding operation, and the recording medium P is affected by the displacement.

Thereafter, the recording medium P is pushed against the reference roller 26 serving as a datum point by the press roller 27, so that the skew is settled. The skew of the recording medium P at fixed intervals after the recording medium P is recovered from the skew depends on the mounting accuracy of the recording medium P on the feed rotating member 22 and the dimensional accuracy of the recording medium P. The frequency of the skew of the recording medium P synchronizes with the rotation cycle of the feed rotating member 22. This is because thick paper with a basis weight of about 200 g/cm$^3$ is used as picture recording paper, so it is susceptible to the mounting accuracy and the dimensional accuracy described above.

The rotation reference shaft 11 that rotates the angle-adjusting head frame 9 and the rotation shaft 26*a* of the reference roller 26 that rotates the recording medium P are disposed at the same position in the plane, that is, concentrically. This configuration allows a control to synchronize the operation of rotating the recording heads 7 using the angle adjusting mechanism 10 with the operation of rotating the recording medium P using the reference roller 26 of the skew restricting mechanism in accordance with the widthwise displacement of the recording medium P skewed with respect to the conveying direction. This configuration can therefore further improve the accuracy of the ink landing positions relative to the recording medium P. In this embodiment, the distance in the conveying direction from the rotation reference shaft 11 that is the rotation center to the recording heads 7 located at the downstream side is 300 mm, and the distance in the conveying direction from the rotation reference shaft 11 to the driving shaft 10*a* of the angle adjusting mechanism 10 is 350 mm, which are relatively long. As described above, the angle adjusting mechanism 10 can control the movement of the driving shaft 10*a* about the rotation reference shaft 11 by 10 μm per step within ±0.5 mm. Therefore, even if the angle of the recording heads 7 is changed by the angle adjusting mechanism 10 during the recording operation, the image to be recorded on the recording medium P is not affected. Accordingly, the widthwise displacement of the recording medium P that occurs at high frequency, which is a factor that causes deviation of landing positions among the nozzle trains of the recording heads 7, can be reduced to 20 μm or less by active adjustment with the angle adjusting mechanism 10 during the recording operation.

As described above, this embodiment is configured to rotate the recording heads 7 relative to the recording medium P in accordance with the displacement of the relative position of the recording medium P skewed in the widthwise direction thereof and the recording heads 7. This configuration allows this embodiment to improve the accuracy of the ink landing positions relative to the recording medium P, thereby improving the recording quality of the recording medium P.

This embodiment can further improve the accuracy of the ink landing positions relative to the recording medium P by matching the rotation center of the reference roller 26 that rotates the recording medium P with the rotation center of the rotation reference shaft 11 of the angle adjusting mechanism 10 that rotates the recording heads 7 in the same plane.

Furthermore, this embodiment can perform high-speed high-quality full-color recording of about 30 to 100 sheets per minute by using the long recording heads in which the plurality of nozzles are arrayed in the widthwise direction of the recording medium P.

Moreover, this embodiment is configured such that the skew sensor 38 is located downstream of the rotation shaft 26*a* of the reference roller 26 and the recording heads 7. This configuration allows the embodiment to perform fine rotation control of the recording heads 7 in accordance with the widthwise displacement of the recording medium P, thereby improving the accuracy of the ink landing position relative to the recording medium P.

Second Embodiment

Next, referring to FIGS. 6A to 6C, a configuration example in which a diagonal feed roller is provided to control the skew of the recording medium P according to another embodiment will be described.

Figure 6A:
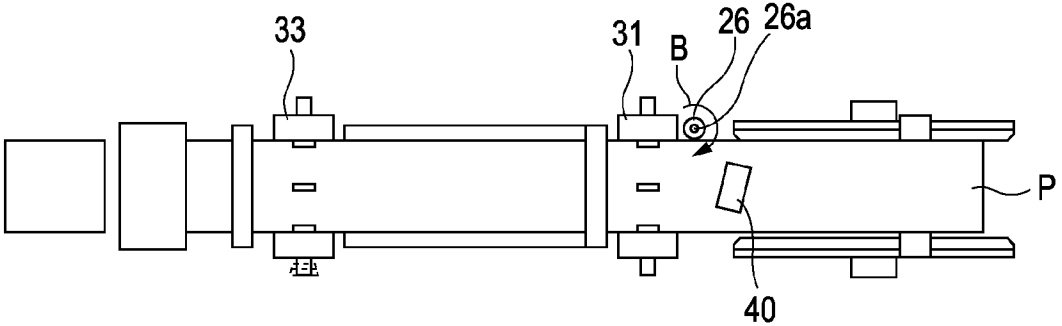
FIG. 6A is a plan view of a conveying mechanism of a second embodiment.
Figure 6B:
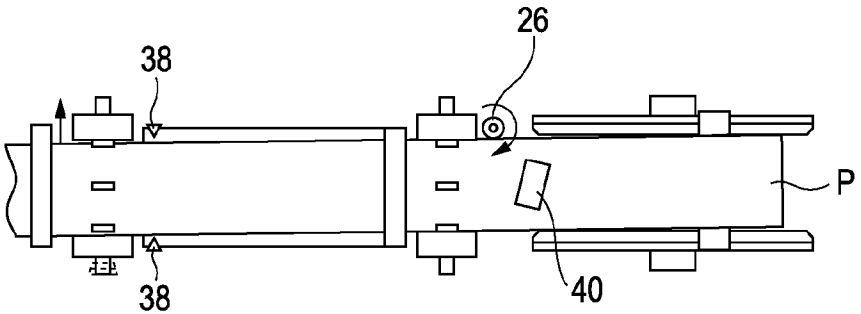
FIG. 6B is a plan view of the conveying mechanism.
Figure 6C:
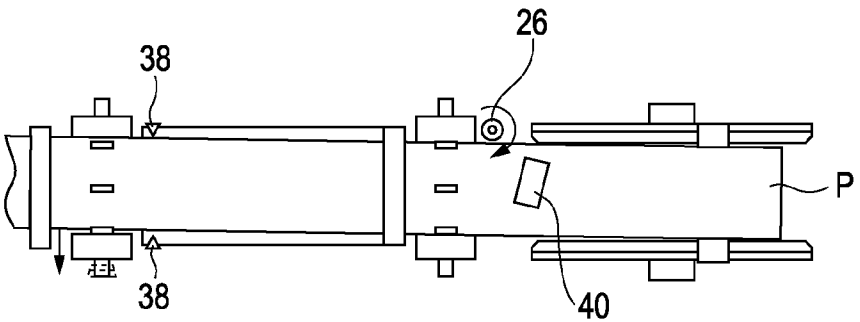
FIG. 6C is a plan view of the conveying mechanism.

As shown in FIG. 6A, a diagonal feed roller 40 in which the axial direction of the rotation axis is disposed at an angle with respect to the conveying direction is provided downstream of the loop detection flag 29 in the conveying direction of the recording medium P. The diagonal feed roller 40 is disposed upstream of the reference roller 26. The diagonal feed roller 40 conveys the recording medium P in a direction skewed with respect to the conveying direction while preventing a decrease in the conveying accuracy and unstable occurrence of skew in the recording medium P due the upstream loop. In this embodiment, the diagonal feed roller 40 is disposed such that the axial direction of the rotation axis thereof is at an angle of about seven degrees with respect to the widthwise direction of the recording medium P toward the downstream side in the conveying direction. This allows the diagonal feed roller 40 to convey the recording medium P at an angle toward one widthwise edge of the recording medium P at which the reference roller 26 is disposed.

The reference roller 26 that is disposed at one side edge of the recording medium P in the widthwise direction downstream of the diagonal feed roller 40 is fixed with respect to the widthwise direction of the recording medium P. The reference roller 26 is configured to convey the recording medium P to the conveying roller 31 while reducing a frictional force acting on the recording medium P by rotating while correcting the skewing direction of the recording medium P conveyed from the diagonal feed roller 40.

This configuration allows the recording medium P to be constantly pushed against the reference roller 26 upstream of the conveying roller 31 with a fixed force. Accordingly, even if the recording medium P is skewed under the influence of the conveying roller 31 and the feed rotating member 22, one side edge of the recording medium P is constantly pushed against the reference roller 26, and thus, the recording medium P is constantly aligned to a position about the rotation center of the reference roller 26. Thus, the active rotation control using the conveying mechanism equipped with the diagonal feed roller 40 and the above-described angle adjusting mechanism 10 that rotates the angle-adjusting head frame 9 can further improve the accuracy of the ink landing position relative to the recording medium P.

While the present invention has been described with reference to exemplary embodiments, it is to be understood that the invention is not limited to the disclosed exemplary embodiments. The scope of the following claims is to be accorded the broadest interpretation to encompass all modifications and equivalent structures and functions.

This application claims the benefit of Japanese Patent Application No. 2008-319632 filed on Dec. 16, 2008 hereby incorporated by reference herein in its entirety.

What is claimed is:

1. A recording apparatus comprising:

a conveying unit configured to convey a recording medium;

a recording unit configured to record on the recording medium;

a retaining unit configured to integrally retain the recording unit;

a supporting unit configured to support the retaining unit so that the retaining unit can rotate, with the recording unit held opposing the recording medium conveyed by the conveying unit;

a detecting unit configured to detect an amount of skew of the recording medium;

a rotating unit configured to rotate the retaining unit on the basis of the amount of skew detected by the detecting unit; and a skew restricting unit disposed upstream of the recording unit and configured to align the recording medium with respect to the widthwise direction and to restrict the skew of the recording medium so that the recording medium is located about a predetermined axis, wherein the supporting unit supports the retaining unit to be rotatable about the predetermined axis.

2. The recording apparatus according to claim 1, wherein the skew restricting unit includes:

a first roller that is supported at one widthwise edge of the recording medium to be rotatable about a rotation reference shaft fixed with respect to the widthwise direction;

a second roller that is disposed at a position opposing the first roller, with the recording medium therebetween, to be movable in the widthwise direction of the recording medium; and an urging unit configured to push the second roller to bring the recording medium into contact with the first roller, wherein the predetermined axis matches a rotation center of the first roller.

3. The recording apparatus according to claim 1, wherein the skew restricting unit includes:

a first roller that is supported at one widthwise edge of the recording medium to be rotatable about a rotation reference shaft fixed with respect to the widthwise direction; and a diagonal feed roller configured to convey the recording medium at an angle so that the recording medium contacts the first roller, wherein the predetermined axis matches a rotation center of the first roller.

4. The recording apparatus according to claim 1, wherein the detecting unit includes a light emitting unit and a light detecting unit configured to receive light emitted from the light emitting unit, the light emitting unit and the light detecting unit being disposed so that the light quantity of the light detecting unit changes with a change in the relative position of the recording medium and the retaining unit, and to detect the amount of skew using the change in the light quantity of the light detecting unit.

5. The recording apparatus according to claim 4, wherein the light emitting unit and the light detecting unit are disposed so that part of the light emitted from the light emitting unit is intercepted by the recording medium and the retaining unit.

6. A recording method comprising:

detecting a change in an amount of displacement of a position of a recording medium that is skewed in a widthwise direction perpendicular to a conveying direction relative to a recording unit when the recording medium is skewed with respect to the conveying direction during a printing operation in which the recording unit ejects ink onto the recording medium; and rotating the recording unit with respect to the recording medium on the basis of the amount of displacement, wherein the skewed recording medium is rotated about a rotation center of the recording unit.

* * * * *